US010383437B1

(12) United States Patent
O'Day

(10) Patent No.: US 10,383,437 B1
(45) Date of Patent: Aug. 20, 2019

(54) LOCKER SYSTEM MODIFICATION KIT

(71) Applicant: Steven J. O'Day, Hammond, IN (US)

(72) Inventor: Steven J. O'Day, Hammond, IN (US)

( * ) Notice: Subject to any disclaimer, the term of this patent is extended or adjusted under 35 U.S.C. 154(b) by 0 days.

(21) Appl. No.: 16/038,267

(22) Filed: Jul. 18, 2018

(51) Int. Cl.
*A47B 61/00* (2006.01)
*A47B 61/02* (2006.01)

(52) U.S. Cl.
CPC ..... *A47B 61/003* (2013.01); *A47B 61/02* (2013.01)

(58) Field of Classification Search
CPC ..... A47B 61/003; A47B 61/02; A47B 96/06; A47B 63/00; A47G 25/74; A47G 25/0671; A47G 25/0692; A47G 25/746; A47F 7/12; A47F 7/19; A47F 7/26; A47F 7/24; A47H 1/102; A47H 1/142; A47H 1/10; A47H 1/02; A47H 1/104; A47H 1/12; A47H 1/122; A47H 1/124; A47H 1/13; A47H 1/14; A47H 1/144
USPC ..... 211/123, 105.1, 90.02, 150, 105, 175, 211/85.3, 16, 88.04; 248/295.11, 297.21, 248/298.1, 214, 251, 252, 254, 255, 256, 248/257, 253, 262, 264, 268, 263, 267; 312/351
See application file for complete search history.

(56) References Cited

U.S. PATENT DOCUMENTS 364,611 A * 6/1887 Swigart ..... A47K 10/025 211/6
481,720 A * 8/1892 Scottron ..... A47H 1/142 248/262
658,006 A * 9/1900 Fullerton ..... A47H 1/142 248/262
720,430 A * 2/1903 Hoffman ..... A47H 1/142 248/262
829,653 A * 8/1906 Kercher ..... A63B 1/00 482/40

(Continued)

FOREIGN PATENT DOCUMENTS

CN 202919489 U 5/2013
CN 203563884 U 4/2014

(Continued)

OTHER PUBLICATIONS

Arsenal Pro Gold Counter-Balanced Smith Machine, Aug. 2016, pp. 1-10, www.raecrowther.com.

*Primary Examiner* — Jennifer E. Novosad
(74) *Attorney, Agent, or Firm* — C. John Brannon; Brannon Sowers & Cracraft PC

(57) ABSTRACT

A kit, including first and second structural members, each having an elongated, generally flat intermediate member with a proximal end and a distal end and a first face and an oppositely disposed second face, an elongated, generally flat notched distal member connected to and extending from the distal end of the elongated, generally flat intermediate member, and an elongated proximal member connected to and extending from the proximal end of the elongated, generally flat intermediate member. Respective elongated slots for receiving a dowel rod formed in the first face of the first elongated proximal member and the second face of the second elongated proximal member. A plurality of fastener apertures are formed through the elongated proximal member. The kit also includes a pair of dowel rods for engaging the elongated slots and a plurality of fasteners for securing the first and second structural members to a locker wall.

6 Claims, 8 Drawing Sheets

(56) References Cited

U.S. PATENT DOCUMENTS 849,035 A * 4/1907 Westenhoff ..... A63B 21/1627 482/40
963,346 A 7/1910 Wilt
983,692 A * 2/1911 Deucker ..... A47H 1/142 248/263
995,805 A * 6/1911 Perry ..... A47B 61/02 211/94.02
1,078,715 A * 11/1913 Cherry, Jr. ..... A47B 61/02 190/13 R
1,272,819 A * 7/1918 Linnett ..... A47G 25/746 190/13 R
1,315,707 A * 9/1919 Cartlson ..... A47H 1/142 248/263
1,391,495 A 9/1921 Parsons
1,494,874 A * 5/1924 Wolff ..... A47H 1/142 248/263
1,509,330 A * 9/1924 Wyatt ..... A47H 1/142 211/105.1
1,510,056 A 9/1924 Hamson
1,543,109 A * 6/1925 Kass ..... A47H 1/102 248/262
1,576,034 A * 3/1926 Butt ..... A47B 5/04 108/134
1,706,683 A * 3/1929 Victorsohn ..... A47B 61/003 206/289
1,722,757 A * 7/1929 Levine ..... A45C 13/03 126/30
1,751,777 A 3/1930 Victorsohn
1,799,521 A * 4/1931 Levine ..... A47B 61/02 190/13 C
1,887,102 A * 11/1932 Mathie ..... A47B 63/02 108/47
1,892,794 A 1/1933 Wertzler
1,997,490 A * 4/1935 Hoar ..... A47B 61/003 211/124
2,068,451 A 1/1937 Elmore
2,379,975 A * 7/1945 Luger ..... D06F 57/12 211/97
2,396,751 A * 3/1946 Resnick ..... A47G 25/746 211/124
2,409,570 A * 10/1946 Kramer ..... A47G 25/746 211/96
D158,154 S * 4/1950 Tritt ..... 211/123
2,525,259 A * 10/1950 Fenzl ..... A47G 25/746 211/124
2,547,893 A * 4/1951 Stutz ..... A47H 1/142 248/263
2,573,348 A * 10/1951 Meadows ..... A47G 25/0692 211/103
2,606,667 A * 8/1952 Hornick ..... A47K 10/10 188/69
2,648,516 A * 8/1953 Manetti ..... A47F 5/0037 221/283
2,796,227 A * 6/1957 Coakley ..... A47K 3/38 211/105.1
2,964,277 A * 12/1960 Sonntag ..... A47H 1/142 248/205.1
3,118,542 A * 1/1964 Lewis ..... A47G 25/746 211/124
3,360,321 A 12/1967 Novales
3,430,908 A * 3/1969 Kowalczyk ..... A47H 1/102 211/105.2
3,563,182 A * 2/1971 MacFarlane ..... A47B 61/003 108/138
3,724,794 A * 4/1973 Anderson ..... E06B 9/50 248/264
3,853,225 A * 12/1974 Gegauff ..... A47G 25/746 211/124
3,866,757 A * 2/1975 Lund ..... A47K 3/38 211/105.1
4,136,847 A * 1/1979 Murray ..... A47H 1/142 248/256
4,226,396 A * 10/1980 Bowers ..... A47H 1/102 248/254
4,283,035 A * 8/1981 Ojembarrena ..... A47H 1/142 248/263
4,373,448 A * 2/1983 Pallotta ..... A47B 96/021 108/29
4,407,476 A * 10/1983 Bohannan ..... A47B 96/021 108/152
4,473,225 A * 9/1984 Miller ..... A63B 1/005 248/264
4,635,889 A * 1/1987 Bell ..... A47H 1/102 211/105.2
4,643,318 A * 2/1987 Kopp ..... A47K 17/022 211/105.1
4,775,056 A * 10/1988 Inglis ..... A63B 1/005 211/100
4,862,812 A * 9/1989 Godfrey ..... A47B 5/006 108/47
4,984,759 A * 1/1991 Perlant ..... B65B 67/1227 108/108
5,011,029 A 4/1991 Sugasawara et al.
5,306,077 A 4/1994 Trevaskis
5,337,905 A * 8/1994 Gast ..... A47B 61/00 211/105.3
5,421,646 A 6/1995 McNamara et al.
5,527,242 A * 6/1996 Gangloff ..... A63B 1/005 482/104
5,951,126 A 9/1999 Wolff et al.
6,381,771 B1 * 5/2002 Kelly ..... A47K 3/003 211/105.1
6,394,289 B1 5/2002 Panchihak et al.
7,086,544 B1 8/2006 Doench
7,316,324 B1 1/2008 Myllykangas
7,780,018 B1 * 8/2010 Sauder ..... A47B 96/00 108/147.16
9,308,427 B2 * 4/2016 Garner ..... A63B 69/0071
9,743,761 B1 * 8/2017 O'Day ..... A47B 61/003
2002/0166829 A1 * 11/2002 Koellner ..... D06F 57/12 211/104
2006/0118505 A1 6/2006 Walter
2013/0099073 A1 4/2013 Bradbury
2014/0034643 A1 2/2014 Canfield et al.
2018/0344026 A1 * 12/2018 Felsenthal ..... A47B 43/003

FOREIGN PATENT DOCUMENTS

CN 204541335 U 8/2015
CN 105310289 A 2/2016
JP 2000245610 A 9/2000
KR 20120005551 U 8/2012

* cited by examiner

LOCKER SYSTEM MODIFICATION KIT

TECHNICAL FIELD

The present novel technology relates generally to the storage furniture industry, and, more particularly, to a kit for adapting a commercial locker with a repositionable support bar.

BACKGROUND

On-site storage lockers have been used to store clothing in the workplace, school hallways, golf clubhouses, athletic locker rooms, and like places. However, lockers have been limited in their versatility to accommodate larger amounts of clothing in an organized fashion. Most lockers are too narrow and/or too shallow to allow for a plurality of jackets, shirts, and the like to fit within in locker while still allowing access to other stored items and for the locker door to be closed.

Thus, there is a need for a system that allows those using or otherwise needing access to a clothing locker, such as a typical worker, student, club member, athlete, and/or uniform supplier or route driver to store a larger volume of clothing and other non-clothing items more efficiently within their locker.

The present novel technology addresses these needs.

BRIEF DESCRIPTION OF THE DRAWINGS

Like reference numbers and designations in the various drawings indicate like elements.

Figure 1:
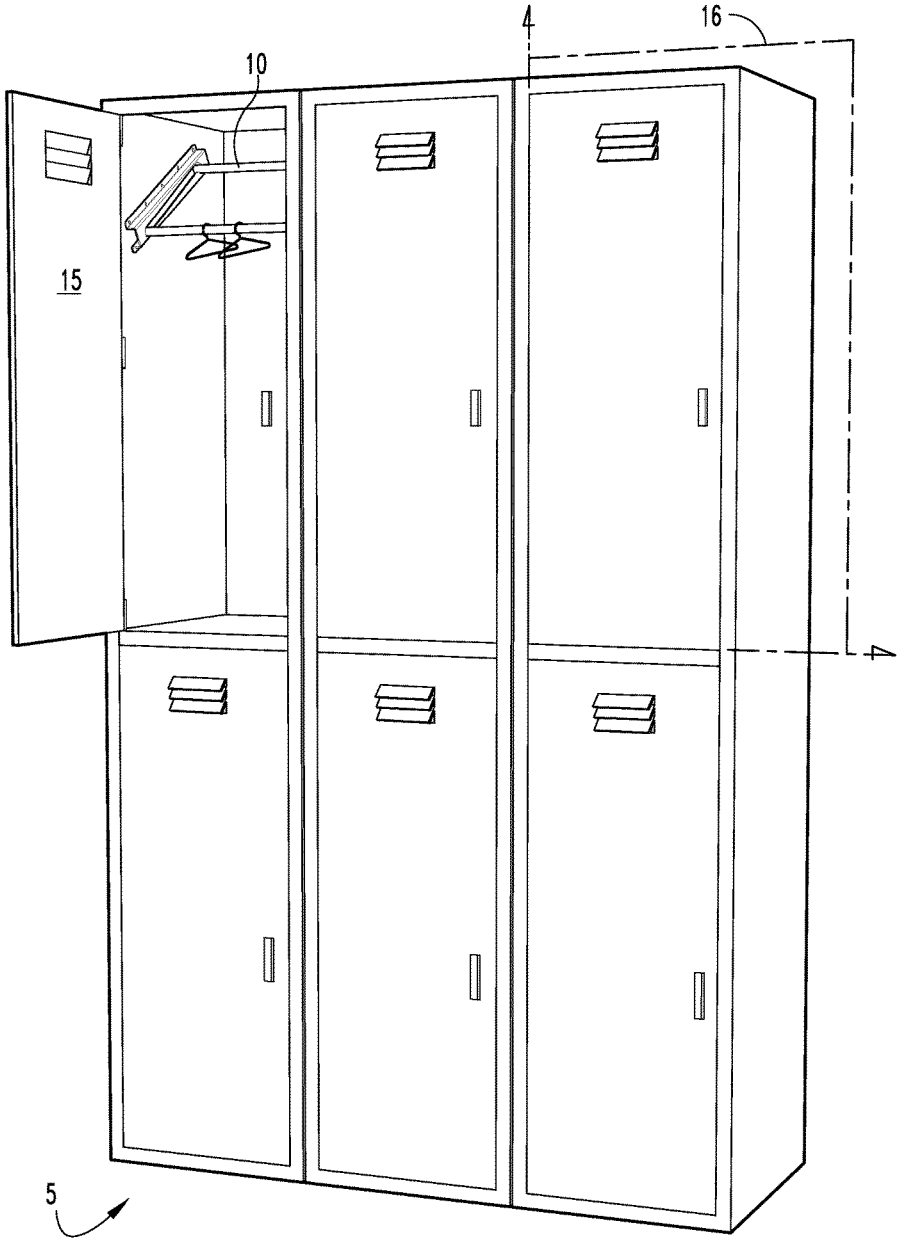
FIG. 1 is an exterior perspective view of a first embodiment of an ergonomic storage locker according to a prior art embodiment.
Figure 2:
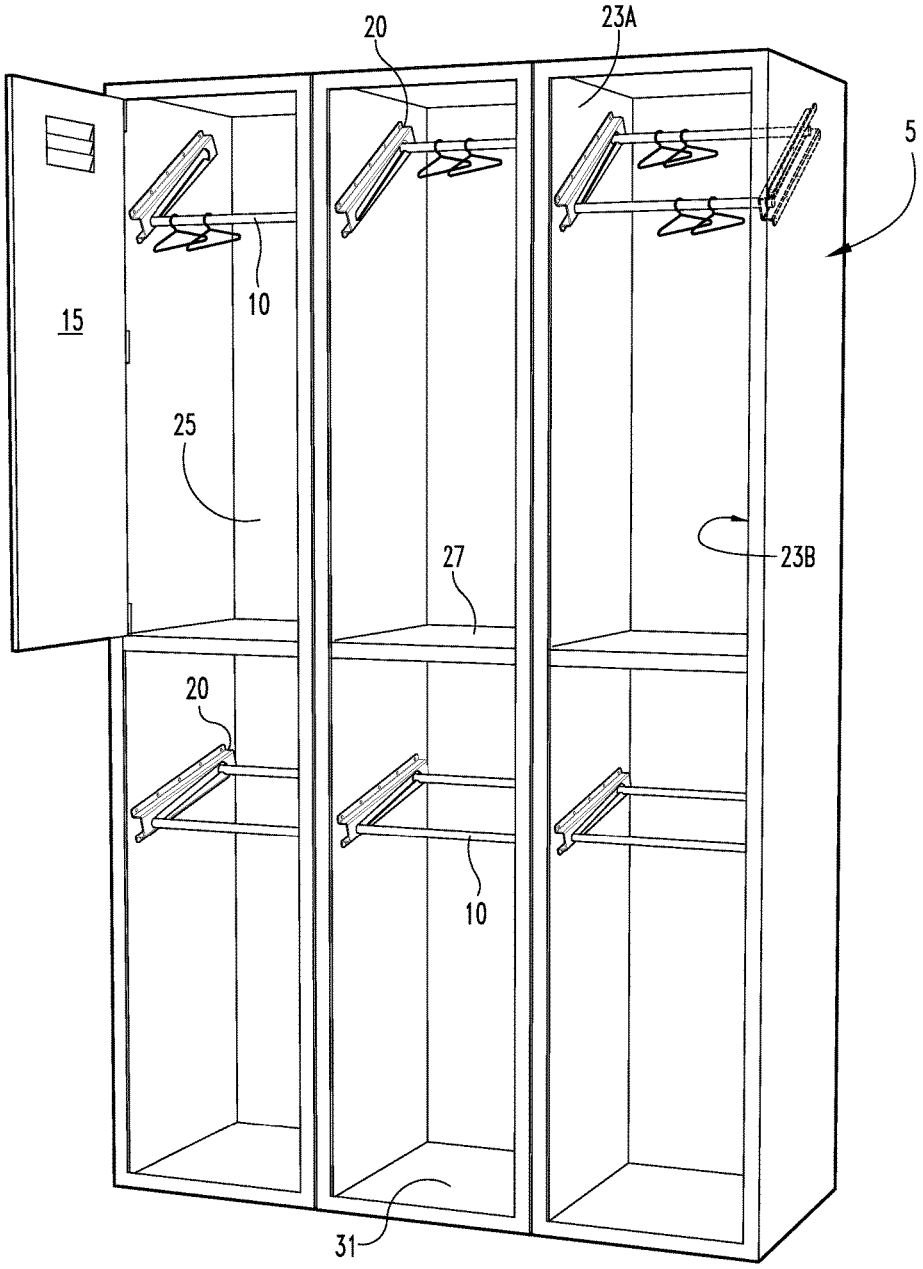
FIG. 2 is a cutaway interior view of the prior art embodiment of FIG. 1.
Figure 3:
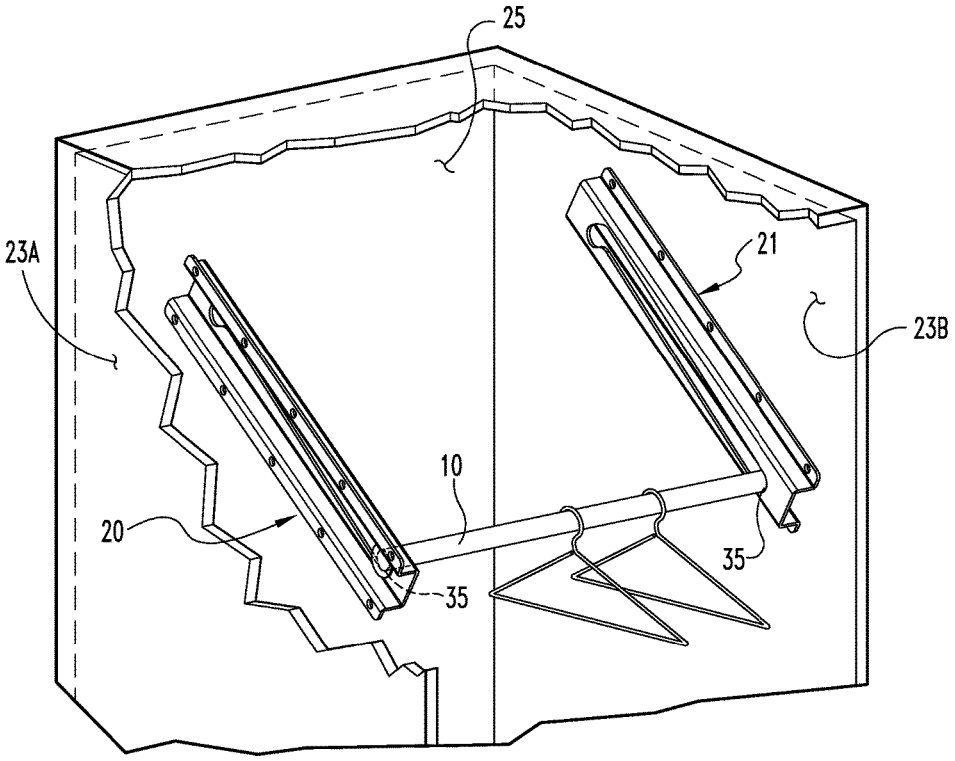
FIG. 3 is a first enlarged partial view of the prior art embodiment of FIG. 2.
Figure 4:
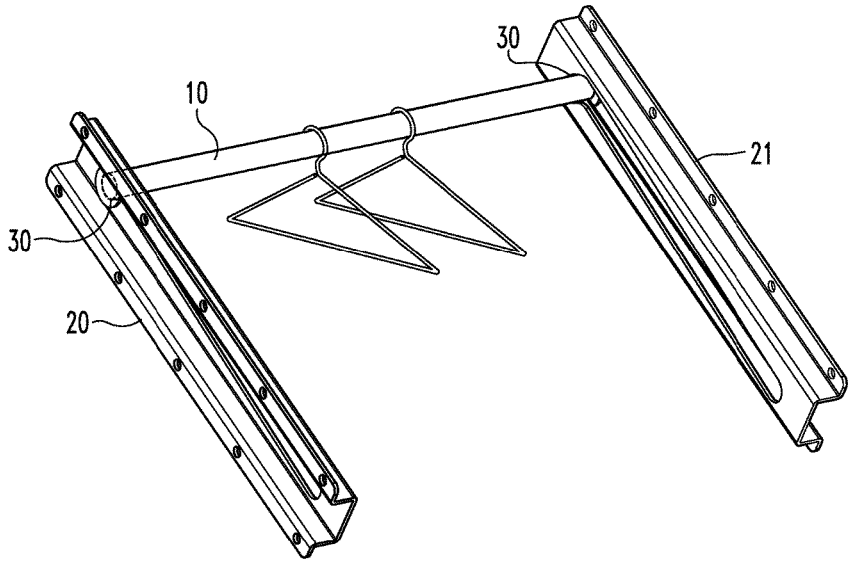
FIG. 4 is a second enlarged partial view of the prior art embodiment of FIG. 2.
Figure 5:
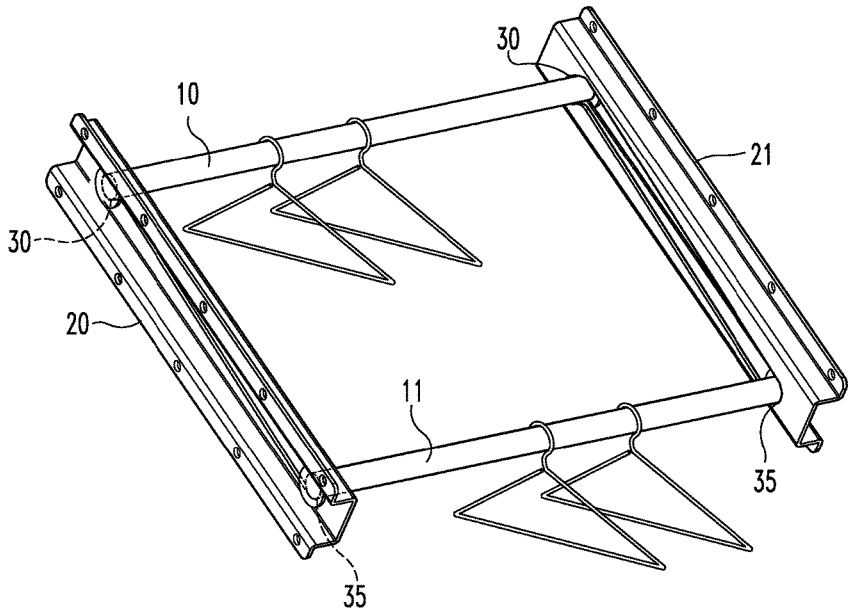
FIG. 5 is a third enlarged partial view of the prior art embodiment of FIG. 3.
Figure 6:
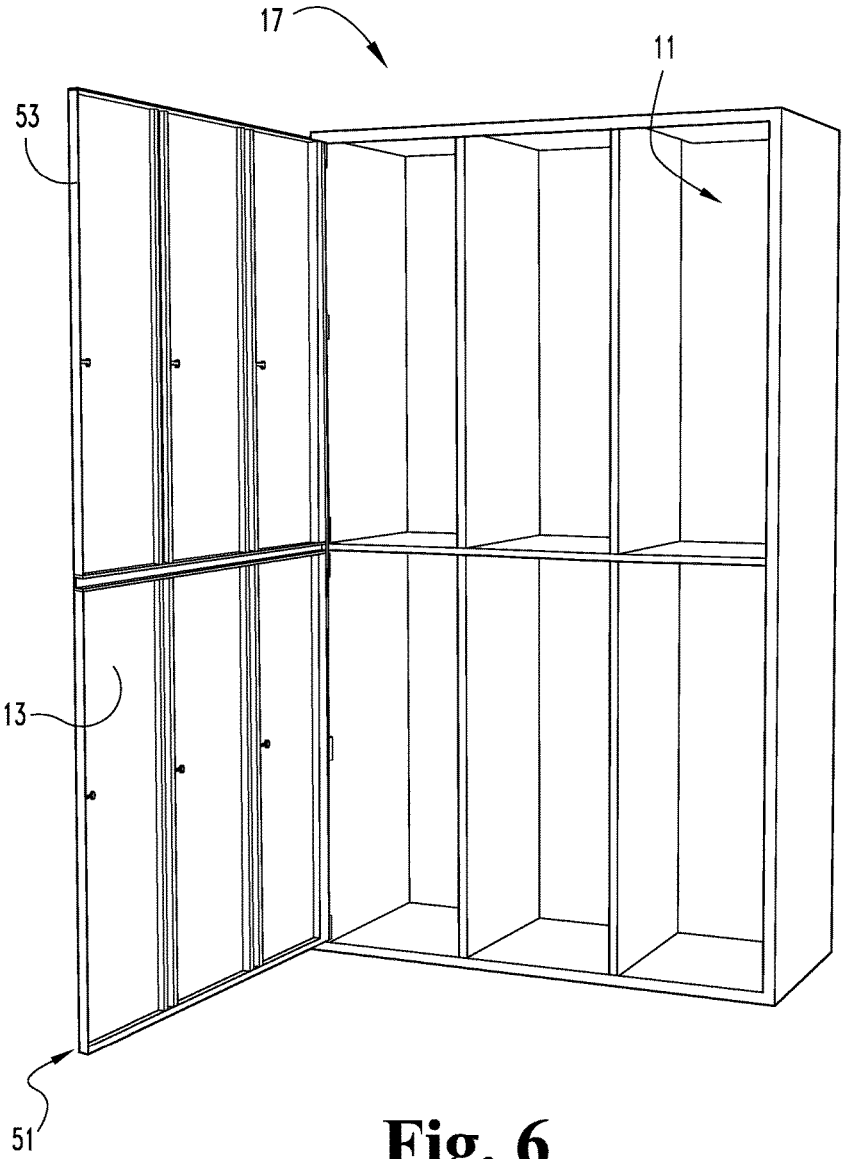
FIG. 6 is a perspective view of the prior art embodiment of FIG. 1 showing the master door open.
Figure 7:
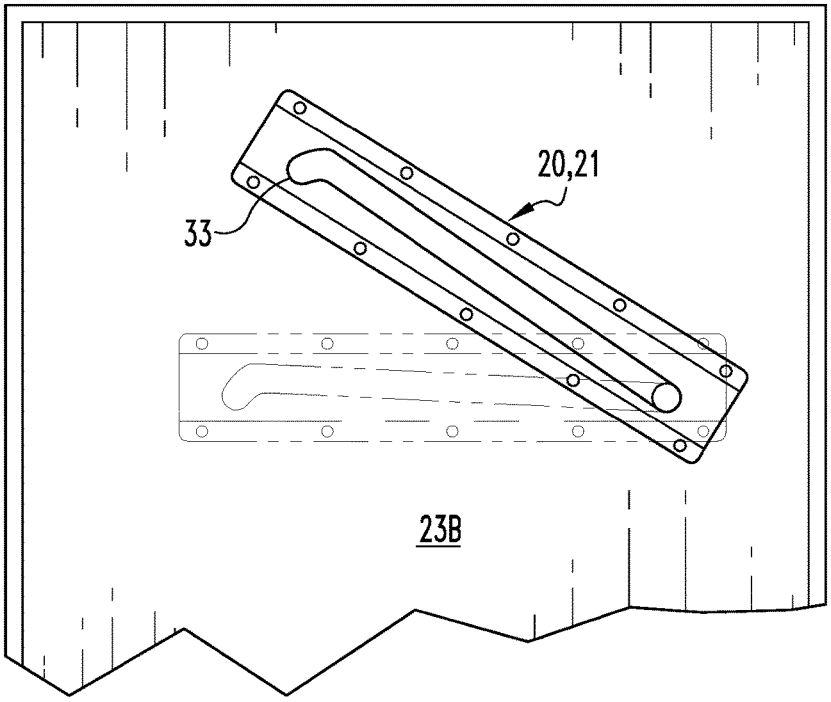
FIG. 7 is an enlarged perspective view of a track and locking mechanism of the prior art embodiment of FIG. 1.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

FIGS. 1-7 illustrate a prior art ergonomic locker system 5 having a repositionable cross-member or bar 10 extending across the interior volume 11 of an individual locker unit 13 that is typically arranged as one of a plurality of units 13 defining a locker bank 17. The bar 10 is typically capable of supporting a plurality of hangers, such as clothes hangers or the like. The bar 10 is suspended between two tracks 20, 21 that are respectively position on oppositely disposed sides 23A, 23B of the locker unit 13. The tracks 20, 21 are typically diagonally oriented with respect to the front wall or door 15 in its pivoted closed position (i.e., the front door plane 16) and rear wall 25 of the locker 5, typically running upwardly from the front portion 15 of the locker to the rear portion 25.

The locker bank 17 typically includes a plurality of elongated locker units 13 positioned side-by-side and connected at adjacent walls or side members 23A, 23B. In some instances, each locker unit 13 is full length or about five to seven feet tall with the bank 17 having a single row of units 13, while in other instances, each locker unit 13 is half-size or about three feet tall, with the bank 17 having two or more rows of units 13, with the second row stacked atop the first, and so on, typically having one or more shelf dividers between the units 13.

Typically, for full length units 13 and/or half-length units 13 positioned on upper rows, the bar 10 is slideable from a typically lower, proximal position 35 on the tracks 20, 21 to a typically higher, distal position 30 on the tracks 20, 21. For lower units, the bar 10 is typically slideable between a first proximal position 35 to a recessed distal position 30 along a horizontal path or even a path that descends slightly from proximal position 35 to horizontal position 30. The bar 10 is typically lockable into the proximal or lower position 35 or distal or higher position 30, such as via locking notch 33 formed in one or both respective tracks 20, 21.

In the case of full length or upper row units 13, the slideable bar 10 allows for users to hang their clothes in the locker 5 when the bar 10 is in the lower, proximal position 35, and then slide the bar 10 into the higher, distal position 30 and lock it there for storage so that the hanging clothes are repositioned up and out of the way of access to the remaining locker volume. With the clothes in this recessed, typically higher position, the locker door 15 is able to more easily close and items stored on the floor or shelves of the remaining locker volume are more easily accessible. Workers, students, and the like, will no longer have to reach up into the back of a locker to load and unload hangers, putting additional, daily wear and tear on the arms, shoulders, and back. The ergonomics involved in the novel technology provide everyday users of an individual locker, and especially bulk users, such as uniform supply employees and the like, an easier way to access clothing by sliding the bar 10 towards them, decreasing the likelihood of work-related injuries from acute or repetitive stressors.

Similarly, for shorter units 13 located lower to the ground, the slideable bar 10 allows for users to hang clothes in the locker 5 when the bar 10 is in the forward, proximal position 35 and then slide the bar 10 into the rearward, distal position 30 and lock it there for storage so that the hanging clothes are repositioned back and out of the way of access to the remaining locker volume. Tracks 20, 21 are thus oriented at (or nearly) horizontal, with only a slight incline or decline from proximal end or position 35 to distal end or position 30.

The locker bank 17 typically has a master door 51, which typically includes the front doors 15 of all of the locker units 13 making up the bank 17 positioned within a framework 53. The master door 51 is pivotably connected to the bank 17 such that it may be opened to expose the interior volumes 11 of all locker units 13 that are members of the bank 17.

The bar 10 is typically disposed seventy-five inches from the base 31 of the locker 5 and three and a half inches into the locker 5 volume or from the front door plane 16 in the first, lower position 35. In the second, elevated position 30, the bar 10 is typically disposed eighty-two inches from the base member or floor 31 of the locker 5 and eleven and a half inches into the locker 5 volume or from the front door plane 16. Of course, in other embodiments, the dimensions may be different. For example, one or more shelfs 27 may be disposed at approximately thirty-six inches above base 31, and each locker may have bar 10 disposed twenty-seven inches from the base 31 (and/or shelf 27) and three and a half inches into the locker 5 volume or from the front door plane 16 in the first, lower position 35. In the second, elevated position 30, bar 10 may then be disposed thirty-four inches from the divider 27 (and/or base member or floor 31) of the locker 5 and eleven and a half inches into the locker 5 volume or from the front door plane 16. In still other embodiments, the base 31 may be considered a shelf portion 27, and dimensions may be based on distance from respective shelves 27.

Additionally, a second removable bar 11 may be added or inserted into the lower, proximal position 35 while the first bar 10 is locked in the higher, distal position 30. This removable bar 11 is manually removed from the proximal position 35 prior to sliding the bar 10 from the distal position 30 into the proximal position 35. This arrangement temporarily expands the storage capacity of the locker 5.

In operation, a user can access the locker volume by first opening the pivotably front door 15 and then moving the bar 10 into the proximal position 35. It may first be necessary to unlock the bar 10 if the bar is locked in its distal position 30. Once the bar 10 is proximally disposed, clothes may be removed from and/or added to the bar 10, such as by undraping/draping over hangers that may be removably suspended from the bar 10. The bar 10 is then repositioned to the distal position 30 and, typically, locked in place. Finally, the locker door 15 is pivoted shut and secured.

Figure 8B:
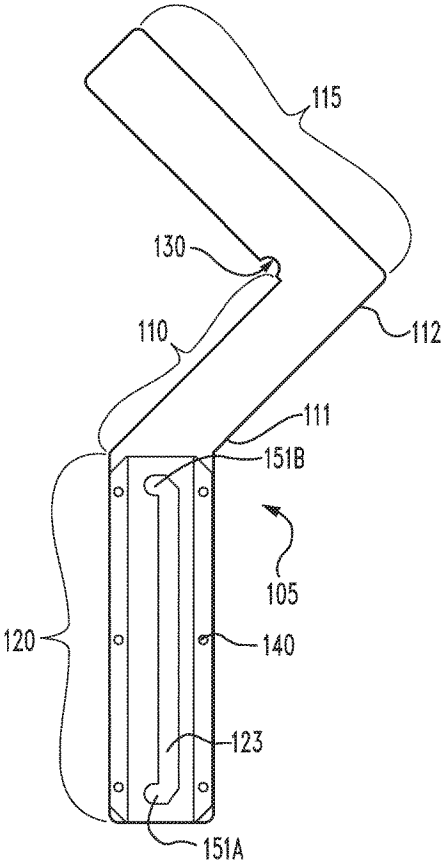
FIG. 8B is a plan view of a locker conversion member of FIG. 8A.
Figure 8A:
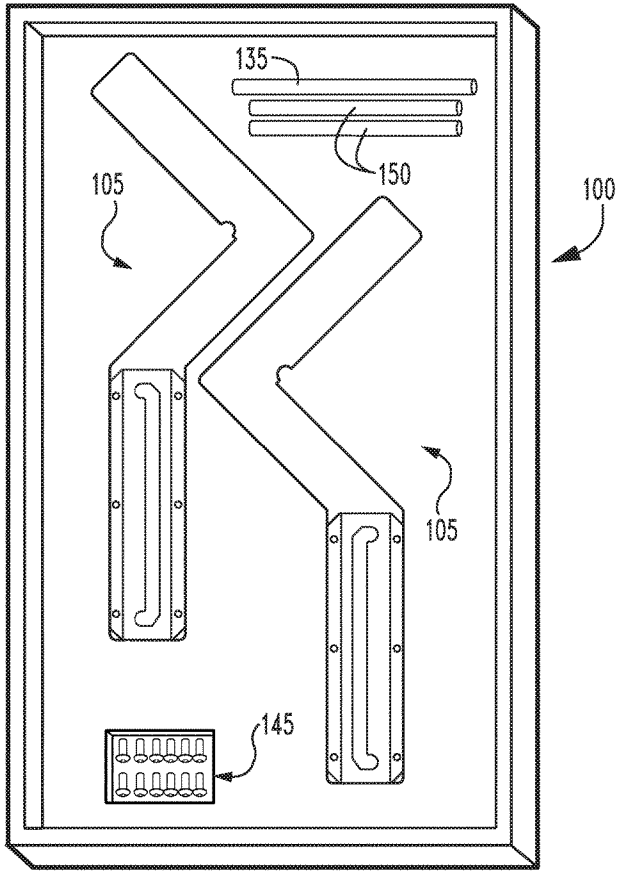
FIG. 8A is a schematic view of a kit for converting standard lockers into ergonomic storage locker according to the present novel technology.
Figure 8C:
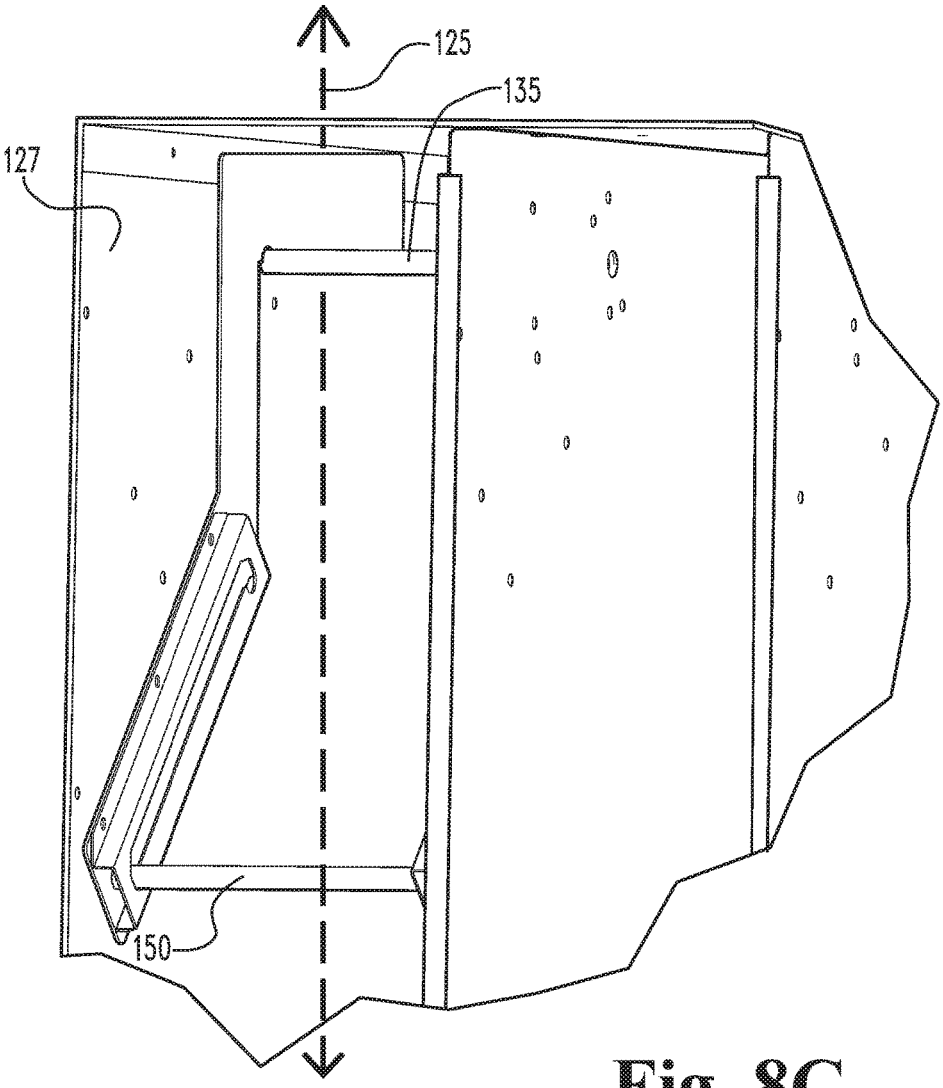
FIG. 8C is a perspective view of FIG. 8B as installed in a locker.

FIGS. 8A-C illustrates an embodiment of the present novel technology, a kit 100 for converting standard lockers into the configuration described above. The kit includes a pair of structural members 105, each having an elongated, generally flat intermediate member 110 having a proximal end 111 and a distal end 112, an elongated, generally flat notched distal member 115 connected to and extending from the distal end 112 of the intermediate member 110, and an elongated, oppositely disposed slotted proximal member 120 connected to and extending from the proximal end 111 of the intermediate member 110. The distal member 115 typically extends from the intermediate member 110 at a right angle. The proximal members 120 each typically have a raised housing portion 121 connected thereto and featuring an elongated slot 123 formed therein and positioned on opposite sides of each respective proximal member 120 relative to the other 120.

When each intermediate member 110 is aligned along the major axis 125 of a locker adjacent a locker side wall 127, the notch 130 may be engaged with a preexisting hanger bar 135 with the raised housing portions 121 facing one another.

Each proximal portion 120 further includes a plurality of apertures 140 formed therethrough, and the kit 100 further includes a plurality of fasteners 145, such as screws or bolts, for cooperative insertion through the respective apertures 140 to affix the respective structural members to the respective sidewalls 127. The kit 100 typically includes a dowel rod 150 for insertion into the respective slots 123. The dowel rod 150 may be moved back and forth along the slots 123 between a first proximal position and a second distal position. Typically, the slots 123 terminate in proximal and distal notches 151A, 151B for securing the dowel rod 150. Kit 100 may also include a rod 135 for installation of the structural members 105 in a locker lacking such a rod.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A locker conversion kit, comprising:

a first structural member, further comprising:

an elongated, generally flat intermediate member having a proximal end and a distal end and a first face and an oppositely disposed second face;

an elongated, generally flat notched distal member connected to and extending from the distal end of the elongated, generally flat intermediate member;

an elongated proximal member connected to and extending from the proximal end of the elongated, generally flat intermediate member;

an elongated slot formed in a first face of the elongated proximal member for receiving a dowel rod; and a plurality of fastener apertures formed through the elongated proximal member;

a second structural member identical to the first structural member, except that the elongated slot is formed in a second face;

a pair of dowel rods for engaging the elongated slots; and a plurality of fasteners for securing the first and second structural members to a locker wall.

2. The kit of claim 1, further comprising:

respective first and oppositely disposed second dowel-securing notches formed in respective elongated slots.

3. The kit of claim 1 wherein each respective elongated proximal member further comprises an elongated, generally flat member and a slotted housing portion operationally connected thereto.

4. The kit of claim 1 wherein the elongated, generally flat intermediate member and the elongated, generally flat notched distal member intersect at a right angle.

5. A locker adapter kit, comprising:

a pair of first and second structural members, each respective structural member further comprising:

an elongated, generally flat intermediate member having a proximal end and a distal end and a first face and an oppositely disposed second face;

an elongated, generally flat notched distal member connected to and extending from the distal end of the elongated, generally flat intermediate member;

an elongated proximal member connected to and extending from the proximal end of the elongated, generally flat intermediate member; and a plurality of fastener apertures formed through the elongated proximal member;

a pair of dowel rods for engaging the elongated slots;

a first elongated slot for receiving a dowel rod formed in the first face of the first elongated proximal member;

a second elongated slot for receiving a dowel rod formed in the second face of the second elongated proximal member;

respective first and oppositely disposed second dowel-securing notches formed in each respective slot; and a plurality of fasteners for securing the first and second structural members to a locker wall.

6. The system of claim 5 wherein each respective elongated, generally flat intermediate member and elongated, generally flat notched distal member intersect at a right angle.

* * * * *